US007178289B2

(12) United States Patent
Gierl et al.

(10) Patent No.: US 7,178,289 B2
(45) Date of Patent: Feb. 20, 2007

(54) SELF-CORRECTING SENSOR FOR AN ENTRANCE

(75) Inventors: Kevin J. Gierl, Pittsburgh, PA (US); Thomas P. Schluep, Mars, PA (US)

(73) Assignee: B.E.A. Holdings, Inc., Pittsburgh, PA (US)

( * ) Notice: Subject to any disclaimer, the term of this patent is extended or adjusted under 35 U.S.C. 154(b) by 0 days.

(21) Appl. No.: 10/662,005

(22) Filed: Sep. 12, 2003

(65) Prior Publication Data

US 2005/0055880 A1 Mar. 17, 2005

(51) Int. Cl.
*E05F 15/20* (2006.01)

(52) U.S. Cl. ..... 49/25; 49/26; 49/28; 49/197

(58) Field of Classification Search ..... 49/25, 49/26, 28, 197, 199; 200/61.43
See application file for complete search history.

(56) References Cited

U.S. PATENT DOCUMENTS

| | | | | |
|---|---|---|---|---|
| 3,462,885 | A | | 8/1969 | Miller |
| 3,864,837 | A | | 2/1975 | Mueress |
| 4,006,392 | A | | 2/1977 | Catlett et al. |
| 4,092,081 | A | * | 5/1978 | Schmanski ..... 404/10 |
| 4,115,952 | A | | 9/1978 | French |
| 4,274,226 | A | * | 6/1981 | Evans ..... 49/25 |
| 4,452,009 | A | | 6/1984 | Baumeler et al. |
| 4,569,495 | A | * | 2/1986 | Woudenberg et al. ..... 248/160 |
| 4,944,116 | A | | 7/1990 | Mewald |
| 4,953,608 | A | | 9/1990 | Larsson |
| 5,079,417 | A | * | 1/1992 | Strand ..... 250/221 |
| 5,285,136 | A | | 2/1994 | Duhame |
| 5,399,851 | A | | 3/1995 | Strand |
| 5,459,963 | A | | 10/1995 | Alexander |
| 5,728,984 | A | | 3/1998 | Miller |
| 5,964,058 | A | | 10/1999 | Richardson |
| 6,082,046 | A | * | 7/2000 | Simmons ..... 49/26 |
| 6,176,039 | B1 | | 1/2001 | Craig |
| 6,179,036 | B1 | | 1/2001 | Harvey |
| 6,209,262 | B1 | | 4/2001 | Mathis |
| 6,443,509 | B1 | * | 9/2002 | Levin et al. ..... 293/4 |
| 6,481,157 | B1 | * | 11/2002 | Haake et al. ..... 49/26 |

* cited by examiner

*Primary Examiner*—Jerry Redman
(74) *Attorney, Agent, or Firm*—The Webb Law Firm

(57) ABSTRACT

A radiation transmitting or sensing element is placed in a generally elongated holder of resilient material so that, if it is distorted by an accidental impact or otherwise, it will automatically re-orient itself when the intruding force is released. The invention is especially useful in safety accessories for automatic overhead doors, garages, and the like.

20 Claims, 3 Drawing Sheets

SELF-CORRECTING SENSOR FOR AN ENTRANCE

TECHNICAL FIELD

Photocells, light beam sensors and other radiation devices for detecting the motion or presence of persons or objects in entranceways and automatic doors are mounted in flexible holders to avoid permanent damage from contact with moving vehicles and the like. The holders are designed to return to an original orientation if they are bent or distorted temporarily.

BACKGROUND OF THE INVENTION

In the automatic industrial door and overhead door industry, there is a concern that, once activated, a moving door may injure persons or property inadvertently in the path of the door. See Richardson's U.S. Pat. No. 5,964,058, which uses an electrical contact to trip a relay to reverse the motion of the door. More commonly, light beams are used at levels where they are apt to be interrupted by pedestrian traffic or vehicles such as automobiles, trucks, fork lifts and the like in order to prevent injury or damage to the vehicles. Safety light or other radiation beams are also used for automatic household garage door opening systems, to assure that the door will stop or reverse its downward motion if the area beneath it is suddenly occupied by a toddler, for example. Halting or reversing the motion of the door without touching the object or person breaking the beam has proven to be an effective safety procedure.

Typically the beam generators and the photocells are installed in metal or other rigid brackets in the door jambs or on adjacent walls. See, for example, Mathis U.S. Pat. No. 6,209,262, Duhame U.S. Pat. No. 5,285,136, Catlett et al U.S. Pat. No. 4,006,392 (sliding door), Boetsch et al U.S. Pat. No. 5,166,681, Harvey U.S. Pat. No. 6,179,036 (light beam for a truck door) and Alexander U.S. Pat. No. 5,459,963. The beam may also be mounted within a flexible tube on the bottom of a vertically moving door. See Miller U.S. Pat. No. 5,728,984, and Strand U.S. Pat. Nos. 5,079,417 and 5,399,851.

Little attention has been paid in the industry, however, to the vulnerability of the photocell supports and supports for light beam or other radiation devices to damage from errant vehicles and other moving objects. Particularly where the light beam projector, photocell, microwave or infrared device or photo receptor holder must protrude from the door jamb, wall, door or other base, the holder is highly likely to be damaged at some point over a period of time. Fork lifts, for example, can be difficult to steer and often contain awkward loads which may accidentally impact the light beam generator or receptor. Even in household garage applications, the support for a light beam generator or receptor cell may be damaged not only by automobiles, but possibly by lawnmowers or other utensils typically stored in the garage.

In U.S. Pat. No. 4,953,608, Larsson describes a displaceable photocell support arm. The arm is slidable within a sleeve on the underside of a door, so that when a base member or abutment on the lower side of the photocell hits the floor, the support arm can slide into the sleeve. While the support arm is displaceable, it is not especially adapted for protection against a transverse impact, and in fact a transverse blow would impair its movement by rendering it incapable of sliding in the sleeve.

Myeress, in U.S. Pat. No. 3,864,837, shows a shroud for a light beam generator. The shroud provides a mounting and a pivot axis for the light beam generator. The device is used in surveying.

The Larsson and Myeress devices mentioned above will not solve the problem of damaged supports for photocells and beam projectors. It must be recognized that the light beam must be directed at the photocell and the photocell must be oriented to receive the light beam. If either is twisted so there is no communication between them, the system becomes totally inoperable, completely defeating any planned safety measures.

Motion and presence detectors used in doorways do not necessarily require separate emitters and receivers on opposite sides of the doorway. As is known in the art, microwave, infrared, and ultrasound emitters can be designed and used to detect a disturbance in a background pattern of reception. For such installations, a single radiation transceiver on one side of the doorway or entrance will suffice. The transceiver will emit, for example, a microwave signal in a direction transverse of the doorway, receive a background pattern represent the area in its usual vacant state, and transmit such a pattern to a microprocessor or other device for comparison to a pattern received when the picture is disturbed by the entrance of a person or object. Such a transceiver, using light, microwave, infrared, ultrasound, or other radiation, may be mounted in a single holder near the door, and is also available for use in our invention.

I am not aware of any support or mounting for a photocell, light beam transmitter or other beam or radiation transceiver which can continue to operate even if it is twisted or bent.

SUMMARY OF THE INVENTION

We have invented a photocell or other radiation assembly that can recover immediately from an impact or blow. In a preferred version, our device comprises a generally tubular support, flexible in at least a portion of its length, having a base end and a working end, containing a photocell (for example) on its working end, through which the necessary wires are placed for connection to the photocell or light beam transmitter. The base end is fastened preferably to a door jamb or adjacent structure, and the working end is oriented to perform a beam projection or reception, or other radiation emission or reception, or both. In the door environment, the system may be placed at a height useful for safety to persons or property—that is, at a height so the beam will detect the unexpected or risk-prone presence of a person or object for triggering a reversal of the door's movement, or for some other safety procedure. By flexible in at least a portion of its length, we mean the generally tubular support will, if impacted and bent, return to its original shape and configuration immediately on release of the deforming force that caused it to be bent. That is, the tubular support will have a shape memory which will enable it to return to its original shape after being distorted.

It should be understood that a photocell is used herein illustratively as a paradigm, and can be a device capable of both generating a light beam and detecting a light beam. While photocells are well known in the industry and we prefer to use them, our invention applies as well to devices capable only of one function or the other—either transmitting a light beam or detecting (receiving) it.

In a broader aspect, our invention comprises a projecting support for a photocell, infrared element, ultrasound element, light beam generator, or light beam receiving element, or any other radiation transmitter, receiver, transceiver, adapted to return to its original shape and/or orientation immediately on release of a force which caused it to become inoperable by altering its shape. Our invention, indeed, is applicable to direction sensitive transmitters and detectors, and other presence or motion detection sensors, including radar, laser, sound, infrared, camera, and any other sending/receiving device for mounting near a door or entranceway that may be made inoperable by damage to its support member. The devices may be active or not—that is, they may transmit radiation for reception by another element, or for reflection back to the transmitting device, or they may simply receive ambient radiation, such as ordinary light or infrared energy. Any such device, active or passive, may be called herein a radiation element.

We intend for the technical and other words used herein to have the meaning normally attributed to them by workers skilled in the art of door monitoring and control, but it may be useful to discuss briefly their use in the context of the description and claims hereof. A sensing element is a transmitter, receiver, or transceiver; it may be for light, microwave radiation, infrared radiation, ultrasound, or any other type of radiation or energy used for presence or motion detection. When directed at the area near a doorway, at least one sensing element will generate an electrical signal representing items or background in the area of the doorway, or simply whether a beam has been broken. A detection system is an electrical system for receiving the electrical signal from at least one sensing element and comparing it to a pattern or normal state for the doorway, or acting on a signal representing a broken beam to generate a further signal such a control signal for causing the motion of an overhead door to reverse itself. As used herein, a photocell is a sensing element which is either a light transmitter, light receiver, or light transceiver, but may be considered generally to represent any or all of the presence or motion detection devices mentioned herein.

DETAILED DESCRIPTION OF THE INVENTION

Figure 1:
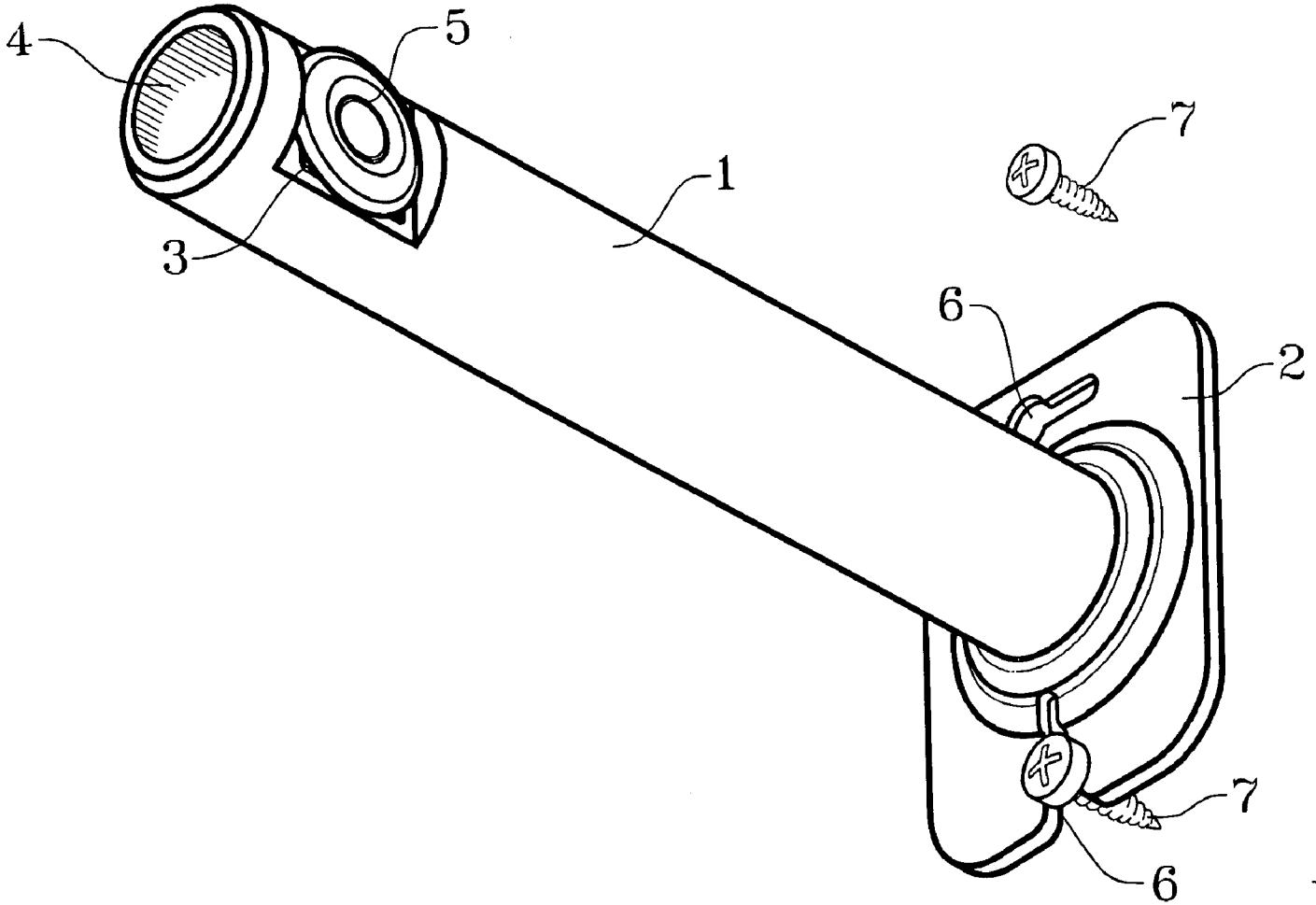
FIG. 1 shows a photocell mounted for a 90° orientation in our flexible support, together with a base for fastening the support to a door jamb or other structure.

Referring now to the preferred version shown in FIG. 1, elongated flexible support 1 is shown attached to base 2. The elongated flexible support 1 has two openings—side opening 3 and end opening 4. In this version, photocell 5 is installed in side opening 3. Base 2 has holes 6 for screws or other fasteners to fix it to a doorjamb or other structure near the door, not shown. Elongated flexible support 1 is made of a rubbery material preferably tough enough so that if it is bent completely—even more than 90°, it will spring back to its original shape. That is, the flexible support 1 has a memory which permits it to resume its original shape and form as soon as a deforming force is released. It may be made of Tygon®, silicone rubber, or other material having flexibility and memory such that it will spring back to its original shape on removal of a bending or distorting constraint. Satisfactory materials include materials having a Shore hardness A, as determined on a durometer, of 40 to 80, preferably 50 to 70, although we do not intend to be limited to these ranges, as the thickness of the material may also have an effect.

Figure 2:
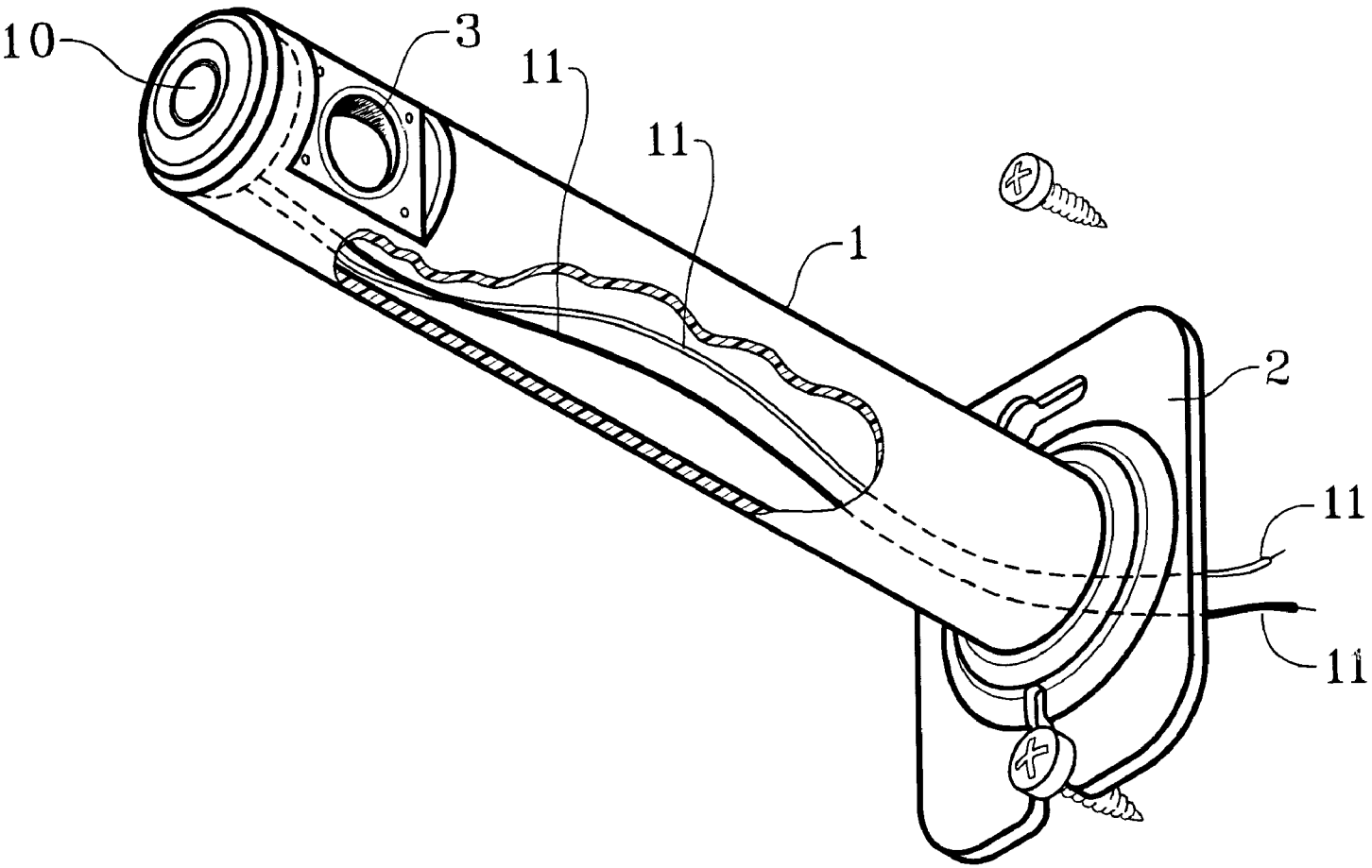
FIG. 2 is a similar view, but the photocell is installed at the end of the flexible support, and the interior wiring is visible.

In FIG. 2, a unit similar to that of FIG. 1 is shown, except that a photocell 10 is mounted in end opening 4 (see FIG. 1) of the flexible support 1. Also, the hollow center area of the flexible support 1 is shown to be exposed so that wires 11 can be seen leading to and from photocell 10. Wires 11 provide power and/or lead to a detection system that may include a microprocessor or simpler device for interpreting a perturbation of the pattern normally received by the transceiver.

Figure 3A:
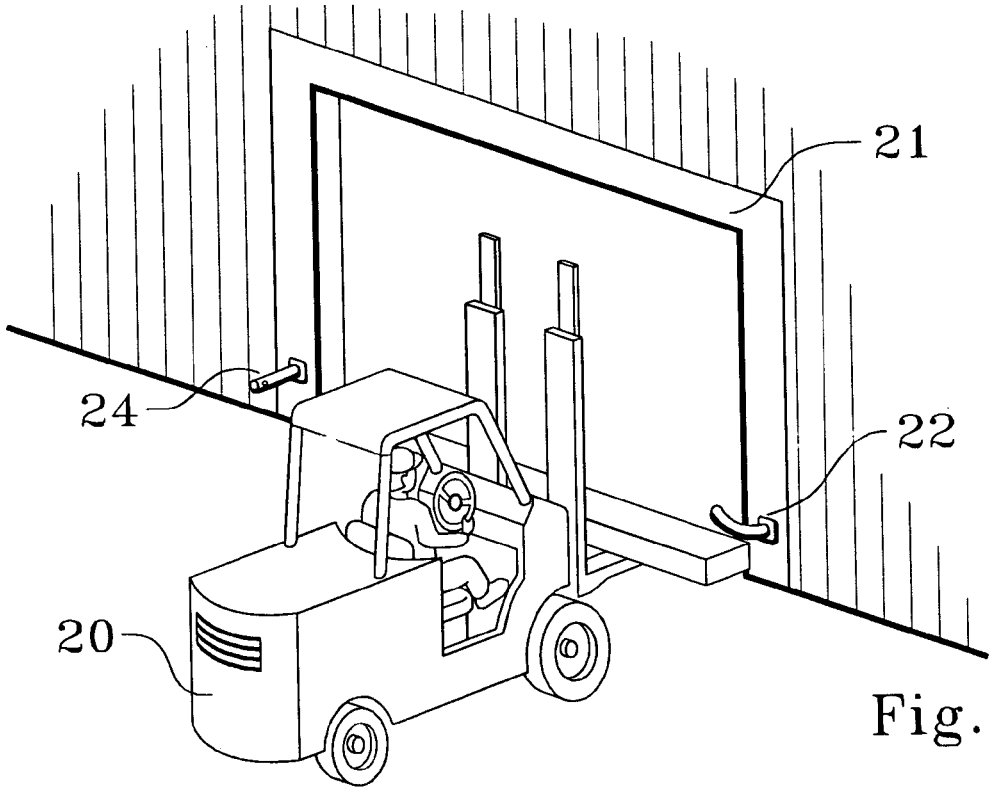
FIGS. 3*a* and 3*b* show a typical installation at a doorway, one of the flexible supports having been bent by the load on a forklift.
Figure 3B:
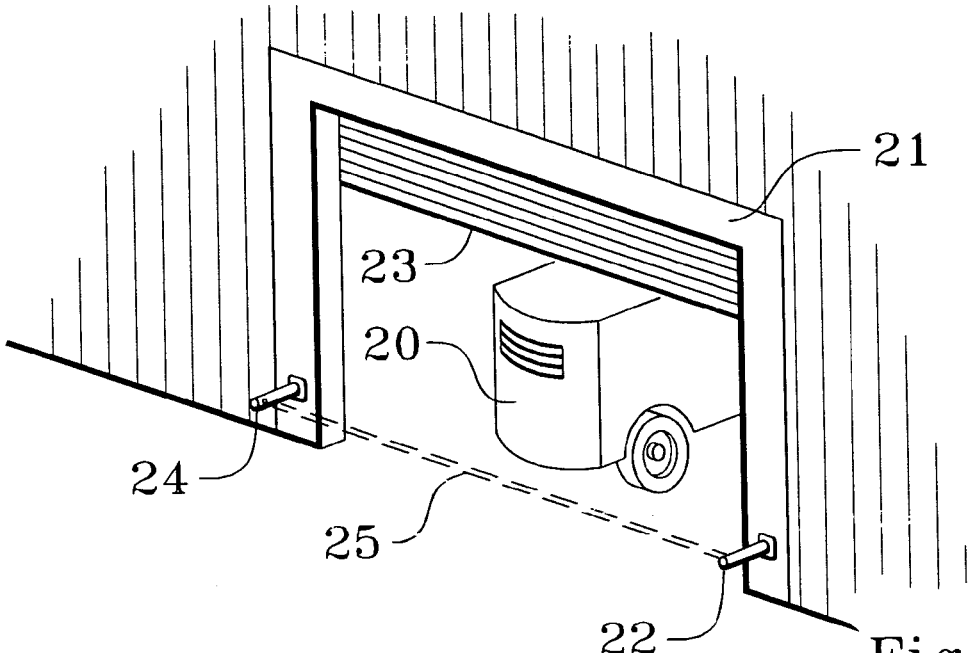

FIG. 3*a* is a more or less simplified view of a doorway 21 having a light beam transmitting device 22 and a light beam receiver 24 on opposite sides of the doorway 21. As seen also in FIG. 3*b*, device 22 and receiver 24 form a two-element arrangement for determining the presence of an object or person in doorway 21. The two-element system may have the purpose of overriding a control which otherwise would close an overhead door 23. For example, the downward movement of overhead door 23 may be reversed if, after a vehicle has passed through, a second object breaks the beam. In FIG. 3*a*, the load on forklift 20 has impacted beam transmitting device 22, bending it. In FIG. 3*b*, the forklift 20 has moved through doorway 21, and the beam transmitting device 22 has reoriented itself in the original position, restoring the door to normal working order—that is, light beam 25 now passes directly from beam transmitting device 22 to light beam receiver 24. It may be noted that transmitting device 22 and receiver 24 are both deployed in the orientation of FIG. 1—that is, the functionality of sending and receiving is oriented at 90° from the axis of elongated flexible support 1.

It may therefore be understood that our invention includes a self-correcting sensing element device comprising a base, a generally elongated flexible support member having a base end, a working end, and an axis in the direction of elongation, the base end fastened to the base, and a sensing element in the working end, the generally elongated flexible support member being capable of returning to its original shape after being deformed.

In another aspect, our invention includes a safety system for an automatic door, for detecting the presence of a person or object in the path of a door in the process of opening or closing, comprising at least one radiation element positioned to detect presence or motion in or near the door and an electrical presence detecting system responsive thereto, wherein the at least one radiation element is mounted on a flexible, generally elongated support, the flexible generally elongated support being capable of returning to its original shape immediately after the release of a bending force.

In yet another aspect, our invention includes a system for detecting the presence of a person or object in the path of an automatic door in the process of opening or closing, comprising a presence detecting system including at least one radiation transmitter on one side of the door and at least one radiation detector on the other side of the door, wherein the transmitter and the detector are mounted on flexible, generally elongated supports, the flexible generally elongated supports being capable of returning to their original shape immediately after the release of a bending force.

The invention claimed is:

1. A self-correcting sensing element device comprising:

a base adjacent a doorway fastened to a doorjamb or other stationary structure an elongated support member having a base end, a working end, and an axis in the direction of elongation, said base end fastened to said base; and a sensing element in said working end, wherein said support member is formed of a flexible material that renders the elongated support member (i) capable of being bent about the axis more than 90 degrees from a starting shape in response to an application of a first force and (ii) capable of returning to the starting shape upon removal of the first force, whereupon:

in the absence of an applied second force, the support member has a first shape, in response to the application of the second force, the support member bends whereupon the working end moves relative to the base end and the support member assumes a second shape different than the first shape; and in response to the removal of the second force, the flexible material forming the support member returns said support member to its first shape.

2. The sensing element device of claim 1, wherein said sensing element is oriented transverse to said axis.

3. The sensing element device of claim 1, wherein said sensing element is oriented parallel with said axis.

4. The sensing element device of claim 1, wherein said support member is made of a material having a durometer Shore hardness A in the range of 40 to 80.

5. The sensing element device of claim 4, wherein said material has a durometer Shore hardness A in the range of 50 to 70.

6. The sensing element device of claim 1, including wires for providing power to said sensing element, said wires being strung through said support member.

7. The sensing element device of claim 1, including wires for connecting said sensing element to a system for detecting the presence of a person or object in a doorway.

8. The sensing element device of claim 7 installed in a doorway.

9. The sensing element device of claim 7, wherein said sensing element is oriented 90° from said axis.

10. The sensing element device of claim 7, wherein said sensing element is a photocell.

11. The sensing element device of claim 7, wherein said sensing element is a microwave transceiver.

12. The sensing element device of claim 7, wherein said sensing element is an ultrasonic device.

13. A safety system for an automatic door for opening and closing a path through a doorway, for detecting a person or object in said path in the process of opening or closing said automatic door, comprising:

at least one radiation element positioned to detect presence or motion in or near said doorway; and an electrical presence detecting system responsive thereto, wherein said at least one radiation element is mounted on a flexible elongated support having a first end held stationary by a structure adjacent the doorway and a second end that moves from a starting position relative to the first end in response to the application of a first force to the flexible, elongated support, the second end of said flexible, elongated support returning to its starting position upon release of the first force the flexible, elongated support is formed of a material that renders the flexible, elongated support (i) capable of being bent more than 90 degrees from a starting shape in response to an application of a second force and (ii) capable of returning to the starting shape upon removal of the second force.

14. The safety system of claim 13, wherein at least one of said radiation elements is mounted transverse to the direction of elongation of said support.

15. The safety system of claim 13, wherein at least one of said radiation elements is mounted at the end of one of said flexible elongated supports.

16. The safety system of claim 13, wherein said flexible generally elongated support is made of material having a durometer Shore hardness A in the range of 40–80.

17. The safety system of claim 13, wherein said flexible generally elongated support is made of material having a durometer Shore hardness A in the range of 50–70.

18. The safety system of claim 13, wherein said at least one radiation element is a photocell.

19. The safety system of claim 13, wherein said at least one of said radiation elements is a passive radiation element.

20. A system for detecting a person or object in the path of an automatic door in the process of opening or closing, said path being a predetermined path for opening and closing said automatic door, comprising a detecting system for detecting said person or object, said detecting system including at least one radiation transmitter on one side of said door and at least one radiation detector on the other side of said door, wherein each of said transmitter and said detector is mounted on an elongated support, that has a first end affixed to a stationary object adjacent the path of said automatic door, each elongated support being made of a flexible material that renders the elongated support (i) capable of being bent more than 90 degrees from a starting shape in response to an application of a first force and (ii) capable of returning to the starting shape upon removal of the first force whereupon:

in response to the application of second force, the elongated support flexes whereupon the corresponding transmitter or detector moves from a first position to a second position; and in response to removal of the second force, the material forming the elongated support returns the corresponding transmitter or detector to its first position.

* * * * *

UNITED STATES PATENT AND TRADEMARK OFFICE

CERTIFICATE OF CORRECTION

PATENT NO. : 7,178,289 B2
APPLICATION NO. : 10/662005
DATED : February 20, 2007
INVENTOR(S) : Gierl et al.

It is certified that error appears in the above-identified patent and that said Letters Patent is hereby corrected as shown below:

Column 4, Lines 66-67, Claim 1, "a base adjacent a doorway fastened to a doorjamb or other stationary structure" should read
-- a base fastened to a doorjamb or other stationary structure adjacent a doorway; --

Signed and Sealed this

Nineteenth Day of June, 2007

JON W. DUDAS
*Director of the United States Patent and Trademark Office*